United States Patent [19]

Gargrave

[11] 4,171,656

[45] Oct. 23, 1979

[54] TOOLS AND DIES FACILITATING ACCURATE POSITIONING OF TOOLS AND THEIR CONNECTION TO RETAINERS

[76] Inventor: Robert J. Gargrave, 4717 James Hill Rd., Dayton, Ohio 45425

[21] Appl. No.: 824,407

[22] Filed: Aug. 15, 1977

[51] Int. Cl.[2] ..... B26D 7/26; B23B 31/04

[52] U.S. Cl. ..... 83/698; 279/87; 408/231

[58] Field of Search ..... 408/226, 231, 232, 238; 83/698; 279/87, 76; 403/2, 358; 285/4

[56] References Cited

U.S. PATENT DOCUMENTS

| | | | |
|---|---|---|---|
| 408,835 | 8/1889 | Grafton | 403/358 |
| 458,408 | 8/1891 | Schwanhausser | 408/231 |
| 2,767,990 | 10/1956 | Jewell, Jr. | 83/698 X |
| 3,245,694 | 4/1966 | Parker | 83/698 X |
| 3,339,215 | 9/1967 | Flood | 285/4 X |
| 3,420,125 | 1/1969 | Cogsdill | 408/226 |
| 3,640,170 | 2/1972 | Bennett | 83/698 |
| 3,673,908 | 7/1972 | Smith | 83/698 X |

*Primary Examiner*—Willie G. Abercrombie
*Attorney, Agent, or Firm*—Jerome P. Bloom

[57] ABSTRACT

The invention is directed to a retainer having a primary bore and a secondary bore parallel thereto with a web therebetween, a tool or die element having a shaft-like portion and also a flange on one end, a groove in the shaft-like portion, said groove extending through said flange to provide a V-shaped notch therein, a frangible rod-like element adapted to project into the secondary bore while positioned in the groove and notch to properly guide and orient said tool in the retainer.

23 Claims, 7 Drawing Figures

TOOLS AND DIES FACILITATING ACCURATE POSITIONING OF TOOLS AND THEIR CONNECTION TO RETAINERS

BACKGROUND OF THE INVENTION

The present invention has particular utility for use in the mounting of tool and die elements to their retainers and will be so described. However, the application of its features is not so limited and such is not intended. It will be obvious from the illustrative embodiments herein disclosed that the invention concepts may be equally utilized in connecting one element in a predetermined relation to another where one thereof has a shaft-like portion to be fixed in a bore provided in the other.

It has long been a primary objective of those working in the tool and die art to provide means whereby the tool and die elements of a die assembly may not only be securely fixed to their retainers but so precisely fixed as to insure their accurate and long term operation without malfunction. It has also been a further and long time objective of those versed in the art to find a means whereby the foregoing objective could be achieved in a simple and economical fashion. That these objectives have not been satisfactorily achieved is evidenced by the multitude of inventions proposed to this end, representative of which are those disclosed in the following patents:

U.S. Pat. No. 3,535,967 issued October 1970
U.S. Pat. No. 3,640,170 issued February 1972
U.S. Pat. No. 3,690,209 issued Sept. 12, 1972
U.S. Pat. No. 3,797,352 issued Mar. 19, 1974
U.S. Pat. No. 3,983,739 issued Oct. 5, 1976

Problems evidenced in use of the apparatus of the prior art for the purpose in question include difficulties in the application of tool and die elements to their retainers without inherently producing undesirable stress factors or misalignment of parts, either of which can cause premature breakage or malfunction and costly production runs and maintenance requirements. Moreover, the application of tool and die elements to their retainers has normally been a time consuming operation. Apart from this, the prior art usually requires the machining of one or more flats on the parts, which flats are difficult to achieve with precision and many times are found difficult to orient. In one case exemplified in the aforementioned prior art patents, pins and flats are employed in a manner giving reasonable results but not so effectively or efficiently or to a level such as enabled by the present invention.

SUMMARY OF THE INVENTION

The apparatus of the present invention includes an improved retainer construction, an improved construction for tool and die elements and a fixing device. While each of the elements may have independent utility per se, in the combination of their features they afford a highly desirable solution to the above noted problems in the tool and die art.

The embodiment of a retainer per the present invention as herein illustrated includes a primary bore and a secondary bore, which bores are in closely spaced side by side relation so as to leave only a web-like wall structure therebetween. The primary bore is designed for an interference fit of a shaft-like body portion of a tool or die element which includes an external annular flange. The secondary bore is designed to receive one end portion of a rod-like fixing element with an interference fit. A tool or die element modified per the present invention includes a longitudinally extending groove in the outer surface portion thereof which is designed for retention in the retainer. This groove is extended through the external flange of this element and shown in the preferred embodiment illustrated to have a V shape. The fixing device to be applied to the secondary bore is formed in the embodiment illustrated to have an elongate rod-like configuration and dimension at one end portion to provide it with an interference fit on insertion thereof in the secondary bore of the retainer so as to induce a projection of a portion of the aforementioned web structure into the primary bore. The arrangement of the rod-like device is such that as one end portion is applied in the secondary bore of the retainer with an interference fit, the remainder projects outwardly of the retainer in a line parallel to the central longitudinally extending axis of the primary bore. By reason of the radial extent provided for the external flange on the tool or die element applied to the retainer, as the tool or die element is inserted in the primary bore the notch in its flange will accommodate therein and in bearing relation to the side walls thereof the projected end of the rod-like fixing device which serves as a guide preventing rotational influence on the tool or die element as it is inserted in the primary bore.

As the tool or die element, the shaft-like body portion of which is designed to have an inteference fit with the primary bore is moved to cause said shaft-like body portion to enter the primary bore, the parallel edges provided by the groove in the body of the tool or die element will inherently serve to add a further directional positive influence on insertion of the tool or die element as they engage the wall of the primary bore with an interference fit.

By reason of the controlled orientation of the tool or die element, in a rotational sense, as influenced by the guiding projected portion of the fixing device, the projected portion of the web-like wall structure between the bores will be in line with the groove in the surface of the tool and die element and be forced to move therein in a manner to produce a lock between the web-like wall structure and the shaft-like body portion of the tool or die element.

The net result is a most simple structural relationship of the parts that is easily and most economically contrived. Moreover, the parts lend themselves to a precision location of the tool and die elements applied to a retainer in accordance with the invention and correspondingly a precise and firmly fixed position of the tool and die elements as required for their proper working function.

A primary object of the present invention is to provide improved means for fixing a shaft-like portion of an element in a retainer in a required position for an optimal function of the element in use. An additional object is to do so in an economical fashion and in a manner to avoid malfunction of the element.

Another object is to provide improvements in tools and dies and mounts thereof which render them easier to accurately install and more efficient and satisfactory in use.

A further object is to provide improvements in tool and die elements facilitating their proper application and a precise fixing thereof to a retainer.

An additional object is to provide improvements in retainers, particularly tool and die retainers, enabling an accurate and more securely fixed relation of the elements which they mount.

Another object is to provide apparatus affording improvements in the positioning and fixing of elements, particularly tool and die elements, to retainers possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing wherein is shown one but obviously not necessarily the only form of embodiment of the invention, FIG. 1 is a fragment of an exploded view of the various elements of the present invention, preliminary to their assembly;

Like parts are indicated by similar characters of reference throughout the several views.

Figure 1:
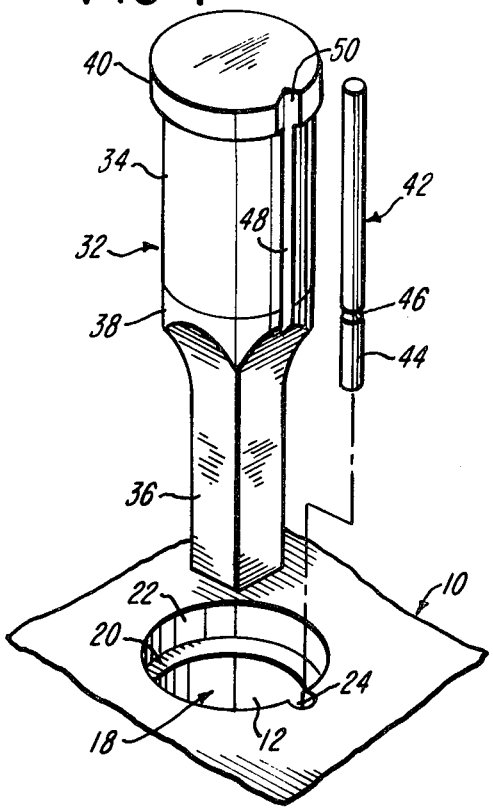
Figure 2:
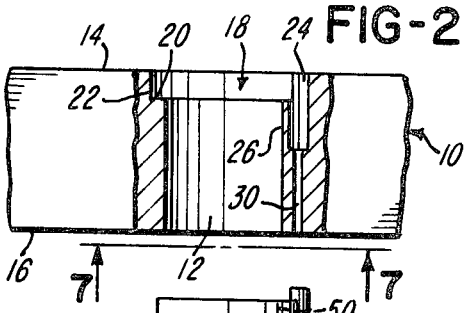
FIG. 2 is a fragment of a tool retainer plate shown partly in cross section to illustrate its pertinent features.
Figure 3:
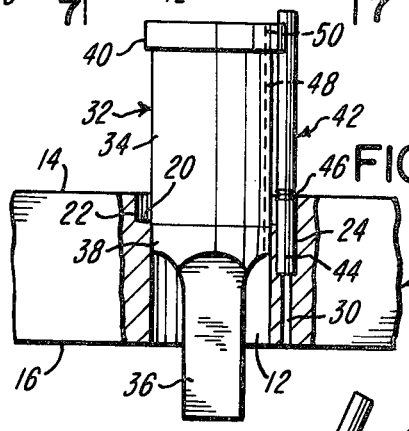
FIG. 3 is a view of the retainer as shown in FIG. 2 and a tool and fixing device per the present invention in the process of their assembly.
Figure 4:
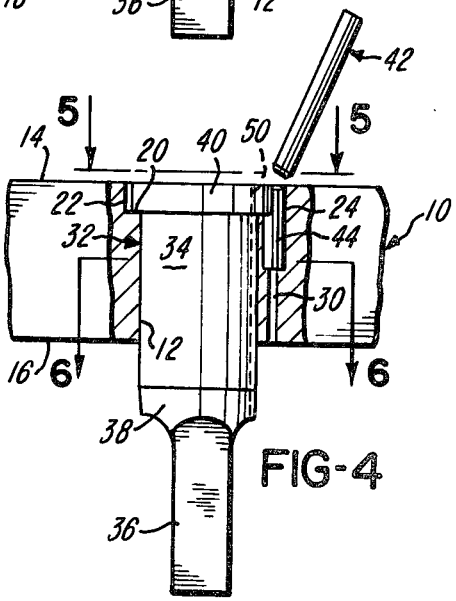
FIG. 4 is a view similar to that of FIG. 3 with the elements thereof fully assembled.
Figure 5:
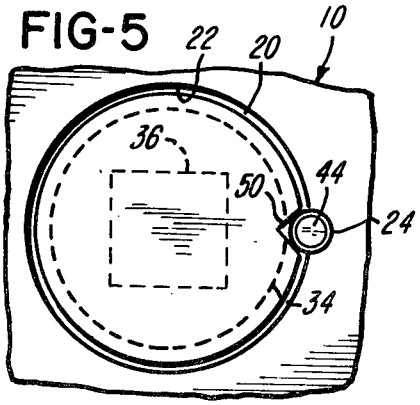
FIG. 5 is a view taken on line 5—5 of FIG. 4.
Figure 6:
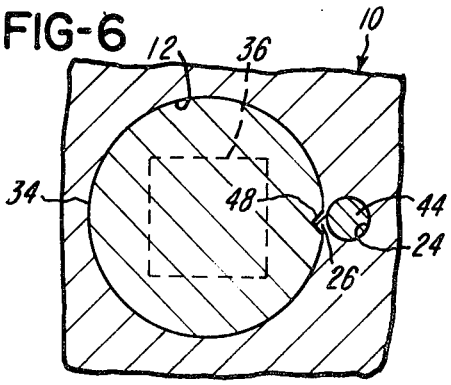
FIG. 6 is a view taken on line 6—6 of FIG. 4.
Figure 7:
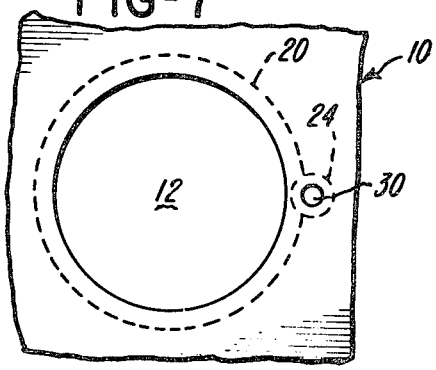
FIG. 7 is a view taken on line 7—7 of FIG. 2.

Referring to the drawings, the body of a retainer 10, in accordance with the invention, may have various shape and application but for purposes of illustration it has a plate-like form, it serves as a tool retainer and it is shown only to the extent necessary to illustrate its pertinent features. Thus, the tool retainer 10 is shown to include in side by side relation, a primary through bore 12 and a secondary bore 24, each of which has a cylindrical cross sectional configuration. The central axis of the bore 12 is perpendicular to the upper face 14 and the lower face 16 of the plate form of the retainer, having reference to the orientation thereof shown in FIG. 2. The bore 12 is expanded by a cylindrical counterbore 18 at the end thereof which opens through the upper face 14, to form thereby an annular shoulder 20 which is parallel to the face 14, bounded at its outer limit by a cylindrical wall surface 22.

Directed inwardly of and perpendicular to the face 14, in adjacent, parallel and closely spaced relation to the bore 12, is the bore 24. The depth of bore 24 is approximately half that of the plate form of the retainer 10 and its diameter is much smaller than that of the bore 12. The bore 24 and the bore 12 are so closely spaced that they are separated at their most closely adjacent portions only by a web-like portion 26 of the body of the retainer 10.

Take particular note that the diameter of the counterbore 18 is such a peripheral portion thereof intersects and forms a notch 28 in that portion of the retainer body 10 which provides the web-like portion 26, at the end thereof extending to the surface 14, and intersects the outermost end of the bore 24.

The body of retainer 10 is shown to include a third bore 30 coaxial with the bore 24 one end of which opens from the retainer surface 16 and the other end of which opens to the innermost end of the bore 24.

The bore 12 is designed, as shown, to receive the shaft-like cylindrically configured head end portion 34 of a punch 32 with an interference fit. The punch, which embodies improvements in accordance with the present invention, includes an elongate working end portion 36 which forms a coaxial extension of and is substantially reduced in cross section relative to the portion 34. In this case the projected extremity of the working end has a configuration which is rectangular in cross section. The head end portion is slightly reduced in cross section at the end thereof which connects to the portion 36 to provide it with a lead end 38 the cross section of which is slightly less in diameter than that of the bore 12. Following this lead end 38 the body of the punch is sloped on four sides to achieve the reduced rectangular cross section of the working end portion 36.

The extremity of the punch 32 remote from its end portion 36 is radially and uniformly expanded to form thereon an an annular external flange 40. The external diameter of the flange 40 is such that as it seats to the shoulder 20 in the counterbore 18, a portion thereof intersects the bore 24 and projects interiorly thereof, approximately to its axial center line.

A further element of the invention apparatus is in the embodiment illustrated, a generally cylindrical rod-like or pin-like device 42. One end portion 44 of the device 42 is formed to have a length corresponding to the depth of the bore 24 and a diameter to produce an interference fit thereof in the bore 24. A circumferential groove 46 provides a break line in the outer peripheral surface of the rod-like device 42 at a point which separates the end portion 44 from the remainder of the length of this device.

The punch 32 is particularly distinguished, per the present invention, by a groove 48 which is formed in and directed longitudinally of its head end portion 34. The groove 48 is extended through the flange 40 to produce therein, in this case, a V-shaped notch 50.

The above described apparatus of the invention is assembled as follows. The rod-like device 42 is first applied to the retainer 10. To this end the one extremity of the device 42 forming part of its portion 44 is forced into the bore 24. Facilitating the application of the device 42 is the projected extremity thereof through the medium of which the device may be tapped to achieve the required interference fit of the portion 44 in the bore 24. In the process of achieving the interference fit in this respect, the web portion 26 of the retainer is forced outwardly so that part thereof projects into the bore 12. In a circumferential sense this projected part of the web 26 is relatively narrow and it assumes, in an axial sense, an essentially straight line form.

Once the device 42 is fixed with respect to the retainer 10 the projected extremity thereof will extend perpendicular to the surface 14 and in parallel relation to the axis of the bore 12. The punch 32 is then applied through the end of the bore 12 which opens from the surface 14, the working end portion of the punch being applied first. As the punch is advanced through the bore and at the time the lead end of its body portion 34 reaches the shoulder 20, the flange 40 on the head end of the punch will be in a position to accommodate, in nested relation thereto, the projected end portion of the device 42. In the process the circumference of this projected end portion of the device 42 will be brought into a bearing relation to opposite side portions of the flange surfaces which define the V-shaped notch 50. At this point, the projected end of the device 42 becomes a guide against which the sides of the notch 50 bear, determining thereby that further insertion of the punch will be controlled by the mutually functioning guide means comprised of the projected portion of the device 42 and the surfaces defining the notch 50 which bear thereon. The guide means so provided determine a straight line and controlled movement of the punch as its body portion 34 enters the portion of the bore 12 following the counterbore 18. It is to be kept in mind that the dimension of the body portion 34 is such to provide it with an interference fit in the bore 12.

Once the body portion 34 enters the portion of the bore 12 beyond the shoulder 20, the circumferentially spaced edge portions of its outer surface which are defined by the outer limits of the divergent walls forming the V-shaped groove 48 will come into engagement with and bear on the inner wall portion of the bore 12 as the body portion 34 is driven further inward of the bore 12 by a suitable tapping of its outermost or head end. The parallel edge portions on the body portion 34 as defined by the groove 48, by reason of the interference fit above described, will lend assistance in establishing the already predetermined straight line path of the punch as it is caused to enter and to dispose the body portion 34 in the bore 12. Further contributing to a precise orientation of the punch 32 is that limited portion of the web 26 which has previously been projected into the bore 12 by the application of the portion 44 of the device 42 in the bore 24. This projected part of the web 28 will be in line with and will be forced into the groove 48. When the punch is driven inwardly of the bore 12 sufficient to seat the flange 40 in the counterbore 18 and to the shoulder 20, the punch will be locked in place and against rotative movement by (1) a pressured engagement of a portion of the web 28 in the groove 48; (2) a pressured engagement of the edges on the outer peripheral surface of the body portion 34 of the punch provided by the formation therein of the groove 48; and a bearing engagement of an outermost end part of the portion 44 of the device 42 in the notch 50 and with respect to the side walls thereof.

Once the punch is fully inserted as described, the projected portion of the device 42 will be broken off, the same being facilitated by the groove 46 which defines a break line located at the surface 14.

Thus, the assembly of the invention apparatus is simple. Moreover, the arrangement is such that not only is there a controlled guidance of the punch upon insertion, to maintain its required orientation but, once the punch is inserted it is also in this case prevented from rotating out of position or being axially displaced.

The bore 30 which communicates with the innermost end of the bore 24 may be used in an obvious manner to drive the pin portion 44 out of the bore 24 if and when necessary for replacement or maintenance purposes. It is of significance that in the preferred embodiment of the invention the notch 50 and the groove 48 have a V configuration in cross section. This particular arrangement gives optimal results and produces a more accurate control of the positioning of the punch than would be the case if the cross section of the notch and the groove was arcuate. The arrangement does in fact preclude radial movements of the parts as well as rotational movements thereof.

When considering the benefits of the present invention, please note that the primary and secondary bores do not overlap. If overlapping bores were utilized, in the formation thereof there would be interrupted cuts and deflection in the machining operation. The latter results in both inaccuracy as to location as well as an out of round condition in the case of overlapping bores.

While the embodiment of the invention herein illustrated has been related to a headed tool, it is equally applicable to a headed die button or any similar device and as a matter of fact the features of the invention may be applied to afford improvements in the art of precisely fixing one element relative to the other where one includes a shaft-like body portion to be inserted in the bore of another.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A retainer for a device such as tool, die or other element having a shaft-like portion comprising a body having a first bore sized and configured in cross section to accommodate the shaft-like portion of the element and a second bore for accommodating a fixing element, said second bore being in closely spaced relation to said first bore and separated therefrom by a web-like portion of said body which is constructed and arranged, on application of a fixing element, to displace, at least in part, in a sense inwardly of said first bore.

2. A retainer as in claim 1 wherein said first bore is a through bore and said second bore has a length or depth which is less than that of said through bore.

3. A retainer as in claim 2 wherein said body includes a third bore access to one end of which is provided at the exterior of said body and the other end of which communicates with said second bore.

4. A retainer as in claim 1 wherein said first bore is a through bore one end of which is expanded by a counterbore which intersects said second bore.

5. A retainer as in claim 1 wherein said first and second bores are cylindrically configured bores which commonly open from one surface portion of said body and said first bore opens also from a surface portion of said body opposite said one surface portion, said first bore is expanded, at least in part, at the end thereof opening from said one surface portion and the expanded portion of said first bore intersects said web to form a notch therein at one end which is located adjacent said one surface portion of said body.

6. A retainer as in claim 5 wherein said expanded part of said first bore provides a cylindrical expansion of said first bore.

7. A retainer as in claim 1 in combination with a fixing device wherein said fixing device has a pin-like form the configuration and dimension of at least one end portion of which is such to provide an interference fit thereof with said second bore sufficient to displace a part of said web-like portion of said body to move it into said first bore.

8. Apparatus as in claim 7 wherein said fixing device is a rod element the length of which is greater than the length or depth of said bore to facilitate its application.

9. Apparatus as in claim 8 wherein said rod element is formed to include a break line to facilitate the breaking off of the portion thereof in excess of said one end portion.

10. Apparatus as in claim 1 in combination with a tool or die element including a working portion at one end and another portion the cross section of which is such to provide for its insertion in said first bore wherein said tool or die element includes therein a recess into which a part of said web porton is projected to fix said tool or die element in a position required for the proper and precise use of its working portion.

11. Apparatus as in claim 10 wherein said recess is a groove which extends longitudinally of the said another portion of said tool or die element and said groove is formed to provide a guide means for the proper insertion of said tool or die element in the said first bore of said retainer.

12. Apparatus as in claim 11 wherein the said another portion of said tool or die element comprises the head end thereof, the extremity of which most remote from said working portion includes a radial projection and said groove is continued through said radial projection and in said radial projection is arranged to intersect the second bore in the application of said tool or die element in the said first bore of said retainer.

13. Apparatus as in claim 11 including a rod-like fixing device having an interference fit in said second bore to induce said part of said web portion to project into said first bore to dispose in said groove to serve a fixing function.

14. Apparatus as in claim 1 in combination with a tool or die element and a fixing device, the body of said tool or die element including a working end, at least a portion of said tool or die body being defined by a line revolved about and in a generally parallel relationship to a central longitudinally extending axis, said portion of said tool or die body having therein a longitudinally extending groove and forming the end portion of said tool or die element which is remote from its said working end, said remote end portion of said tool or die body including a peripheral radial projection through which said groove is extended, one end portion of said fixing device being applied in said second bore with an interference fit to produce said displacement of a part of said web portion into said first bore, said fixing device including a rod-like portion which is adapted to extend from said second bore and to serve as a guide for the body of said tool or die element in the insertion thereof in said retainer by positioning in the portion of said groove within said radial projection and the said groove in said tool or die element forming guide portions on the body thereof which functionally relate to the wall of said first bore and to said displaced part of said web-like portion of said retainer body to provide for a positive orientation and fixing of said tool or die element, in a rotational sense, as it is positioned within said first bore of said retainer.

15. Tool or die apparatus comprising a body forming a tool or die element including a working end, at least a portion of said body having its configuration defined by a line revolved about and in a generally parallel relationship to a central longitudinally extending axis of said body to provide for said body to be mounted with an interference fit in a bore of a retainer within which it must be held for working purposes, said portion of said body being intersected by a longitudinally extending groove the line of which is generally parallel to said axis, the configuration of said groove being such that the opening thereto at the outer limits of said body is formed by well defined generally parallel edge portions of said body which serve as guides to maintain a desired relation of said body with respect to said retainer as it is inserted with an interference fit in an accommodating bore of the retainer, and the extremity of said portion most remote from said working end including a generally radial projection through which said groove is extended and said radial projection by virtue of said groove providing means through the medium of which said body may be guided into its bore in a retainer to assume a position in said bore which is that precisely required, in a rotational sense.

16. A tool or die element as in claim 15 wherein said groove, in transverse section, has a configuration which is substantially the shape of a V.

17. Tool or die apparatus comprising a body forming a tool or die element including a working end, at least a portion of said body having its configuration defined by a line revolved about and in a generally parallel relationship to a central longitudinally extending axis of said body, said portion of said body being intersected by a longitudinally extending groove the line of which is generally parallel to said axis, said groove, in transverse section, having a configuration which is substantially the shape of a V, a retainer providing a first bore in which said portion of said body is inserted, said retainer having a second bore parallel to and in closely spaced relation to said first bore, a portion of said retainer intermediate said bores being displaceable to be accommodated in said V groove and provide for a predetermined fixed positioning of said body whereby to establish a required location and orientation of the working end of said body.

18. Tool or die apparatus according to claim 15, wherein said longitudinally extending groove in said radial projection assumes the form of a relatively deep and wide radial indentation, an innermost portion of said indentation penetrating into said portion of said body to define therein a more shallow portion of said groove.

19. Tool or die apparatus according to claim 18, wherein said indentation in said radial projection has, in transverse section, a configuration which is substantially the shape of a V, side walls of said indentation at and adjacent to convergent ends thereof penetrating said portion of said body, said groove being thereby more narrow in said portion of said body than in said radial projection.

20. Tool or die apparatus according to claim 19, in combination with a retainer having a bore for insertion of said body therein and a counterbore accommodating said radial projection, and a pin installed in said retainer and cooperating with said grooved tool or die element to guide said element into said bore in a proper position of rotational adjustment and positively to locate said element in an inserted position, said pin having an end portion installed in said retainer for locating purposes and a portion projecting from said retainer for guide purposes, and said projecting portion of said pin being separable from said end portion thereof.

21. The combination of a tool, die or like element, a retainer providing a first bore for installation therein of said element, and a locator pin cooperable with said element for fixing the rotational position thereof in said retainer, said element having therein a recess in a portion of the body thereof, said retainer having a second bore receiving one end portion of said locator pin, said pin, in the application thereof, projecting from said second bore and said retainer and the projected portion thereof being arranged to act as a guide adapted to enter said recess in said element to direct said element into said first bore in said retainer in a selected position of rotational adjustment, and the projected portion of said locator pin being constructed and arranged to separate from said one end portion thereof upon said element being fully installed in said first bore.

22. A combination as in claim 21, said locator pin having intermediate its ends a weakened portion defining an upper terminus of said end portion thereof, said projecting portion of said pin being separable by being broken off at said weakened portion, and said companion bore having a depth corresponding approximately to the length of said end portion of said locator pin.

23. A combination as in claim 22, said bore for installation of said tool, die or like element therein and said companion bore being separated by a web-like portion of said retainer deformable by insertion of said locator pin into said companion bore, said tool, die or like element having an indented configuration into which said web-like portion is formed.

* * * * *

UNITED STATES PATENT AND TRADEMARK OFFICE

CERTIFICATE OF CORRECTION

PATENT NO. : 4,171,656

DATED : October 23, 1979

INVENTOR(S) : Robert J. Gargrave

It is certified that error appears in the above-identified patent and that said Letters Patent are hereby corrected as shown below:

Col. 3, line 61, -- that -- is inserted following "such".

Col. 6, line 34 (Claim 1, line 1) -- a -- is inserted following "as".

Col. 7, line 8, (Claim 8, line 3), -- second -- is inserted following "said".

Col. 7, line 18 (Claim 10, line 6) "porton" is corrected to read -- portion --.

Signed and Sealed this

*Eleventh* Day of *March 1980*

[SEAL]

*Attest:*

SIDNEY A. DIAMOND

*Attesting Officer*

*Commissioner of Patents and Trademarks*